US006446474B1

(12) United States Patent
Tabacchi et al.

(10) Patent No.: US 6,446,474 B1
(45) Date of Patent: Sep. 10, 2002

(54) KEY OPERABLE RESTRAINING DEVICE WITH SPIKE ENGAGING MEMBER

(75) Inventors: Otavio R. Tabacchi, Littleton; Thomas D. Liston, Aurora, both of CO (US)

(73) Assignee: Secure Concepts, Ltd., Englewood, CO (US)

( * ) Notice: Subject to any disclaimer, the term of this patent is extended or adjusted under 35 U.S.C. 154(b) by 0 days.

(21) Appl. No.: 09/573,011

(22) Filed: May 17, 2000

Related U.S. Application Data

(60) Provisional application No. 60/134,444, filed on May 17, 1999.

(51) Int. Cl.[7] ..... E05B 75/00

(52) U.S. Cl. ..... 70/16; 70/17; 70/18; 70/15; 70/58; 70/49; 24/16 PB; 24/16 R; 24/30.5 P; 24/484; 128/869; 128/876; 128/877; 128/878; 128/879-882; 219/318; 219/319; 248/61; 248/68.1; 248/74.3

(58) Field of Search ..... 70/16–18, 15, 70/58, 49; 24/16 PB, 16 R, 30.5 P, 484, 17 AP; 128/869, 876, 877, 878, 879–882; 219/318, 319; 248/61, 74.3, 68.1

(56) References Cited

U.S. PATENT DOCUMENTS 4,993,669 A * 2/1991 Dyer ..... 248/61
5,159,728 A * 11/1992 Bingold ..... 24/16
5,193,254 A * 3/1993 Geisinger ..... 24/484
5,377,510 A * 1/1995 Smith ..... 70/16
5,398,383 A * 3/1995 Bingold ..... 24/16
5,794,461 A * 8/1998 Smith ..... 70/16
6,196,033 B1 * 3/2001 Dowdle ..... 70/16

FOREIGN PATENT DOCUMENTS

WO WO 97/13946 * 4/1997

* cited by examiner

*Primary Examiner*—William A. Cuchlinski, Jr.
*Assistant Examiner*—Ronnie Mancho
(74) *Attorney, Agent, or Firm*—Sheridan Ross P.C.

(57) ABSTRACT

A key operated restraining device is provided to create a securing loop of adjustable dimension. The device includes a locking head portion, an elongated smooth surfaced strap insertable into the locking head portion to form a securing loop of adjustable dimension, a support block disposed in the interior of the head portion, and a pawl member. Both the support block and the pawl member terminate in a spaced relation to an interior wall surface of the head portion and form a slideway for the strap operation. The pawl member is connected to the locking head by a resilient hinge structure with a spike inserted into or attached to the pawl biasing the pawl member into a locking position wherein the locking structure is operative to lockably engage a smooth strap and a release position wherein the locking structure is disengaged from the strap.

13 Claims, 4 Drawing Sheets

KEY OPERABLE RESTRAINING DEVICE WITH SPIKE ENGAGING MEMBER

RELATED APPLICATION

This application claims priority from U.S. Provisional Patent Application No. 60/134,444 filed on May 17, 1999. The entire disclosure of the provisional application is considered to be part of the disclosure of the accompanying application and is hereby incorporated by reference.

FIELD OF THE INVENTION

The present invention broadly relates to tying devices, which can be used to secure objects together. More specifically, the present invention relates to tying devices known as "cable ties" especially as they are employed as wrist and leg cuffs.

BACKGROUND OF THE INVENTION

The need to quickly and temporarily restrain individuals taken into custody by peace officers has long been known. This is necessary both to prevent escape of those persons while being transported to detention facilities as well as to reduce the likelihood of injury to law enforcement personnel after taking an individual into custody. Traditionally, steel handcuffs have been employed for this purpose. Here, as is known, the standard steel handcuff device includes a pair of lockable rings, which extends around the wrists or ankles of a person with these rings being secured together by a short length of chain.

Due to the expense and bulkiness of traditional metal handcuffs, however, various law enforcement and peace-keeping agencies have sought out replacement devices, which can be used as temporary restraints on persons taken into custody. One such device, which has received significant interest, is the traditional cable tie, which is a device used to bind objects together in a bundle or for other similar purposes. The traditional cable tie includes a locking head that has a relatively open interior with a locking pawl formed therein. An elongated strap extends from the locking head and can be bent upon itself to form a closed loop upon insertion through the locking head. The elongated strap has teeth running a substantial portion of its length so that the loop formed by the strap maybe reduced in size by continued insertion of the strap through the locking head. The ratcheting pawl locks against these teeth and prevents withdrawal of the strap or expansion of the dimension of the loop.

Cable ties have a number of distinct advantages when used to secure objects. Cable ties can accommodate bundles of varying sizes and shapes. Also, because the loop which secures the objects is not formed until the user inserts the free end of the strap through the locking head, there is no need to position an object through an already closed loop. Rather, the strap may simply be trained around the object to be secured and the free end is then easily attached by simply inserting the free end of the strap through the locking head. Also, cable ties have the advantage of being made of lightweight yet strong plastic material. Another advantage of cable ties over other methods of securing objects is that after installation, pulling the free end of the strap tightly through the locking head may increase the tension on the looped strap.

It has also been known for some time that cable ties and similar devices employing flexible straps that are adjustably looped into locks that use one way ratchets can be used as cuffs to restrain a person taken into custody. Here, the cable tie is simply looped around a person's wrists or ankles, and the loop is tightened so that the extremities are bound together thus preventing free use of the person's arms and/or legs. With respect to the arms, this is typically accomplished with the person's hands being placed behind his or her back. Law enforcement personnel have used cable ties for this purpose for some time in place of the traditional metal handcuffs because the lightweight nature and inexpense of the cable ties.

A drawback in the use of traditional cable ties and similar ratcheting locking strap devices is that they typically can only be used a single time. Thus, in order to release a restrained person, it is necessary to cut the cable tie from the wrist and/or ankles. This destroys the usefulness of the device so that it must be replaced after every use. Moreover, during the removal operation, there is some risk of injury either to the restrained person employing the cutting instrument should the restrained individual struggle or otherwise move. Another danger in such devices is that the restrained person may either purposely or inadvertently pull on the free end of the strap thereby reducing the size of the fastening loop to an extreme that might cut off blood circulation to the extremities. At this point, the restraining device must be removed and, if destroyed, a new device employed. This is often not convenient or even possible in most situations where restraining devices are employed.

In addition to the traditional cable tie, other restraining devices operating on the concept of free strap looped into a ratcheting lock have been developed. These include, for example, U.S. Pat. No. 4,071,023 to Gregory that includes a pair of free straps and a pair of ratcheting locks. U.S. Pat. No. 5,088,148 to Burkholder is similar to the Gregory patent, but includes a pair of ratcheting locks that are positioned on a single mount. U.S. Pat. No. 5,099,662 to Tsay includes a mechanism to release a ratchet to allow reuse of the device. U.S. Pat. No. 4,964,419 to Karriker includes a mechanism to expand and contract the cuff size. U.S. Pat. Nos. 5,794,461 and 5,377,510 by Smith use a plurality of teeth in a reusable device which limits the ability to adjust the loop and requires a particular toothed locking structure so that effective contact can occur between the toothed strap and the complementary locking head. The devices described in the Smith patents use a plastic hinge and pawl. In actual use the hinge can be over rotated and destroyed. Moreover, the plurality of teeth only allows for so much variation of the loop diameter.

There is therefore a need for a restraint device that is reusable and is operable with a key in a fashion that allows for infinite adjustability without the complicated locking tooth structures as set forth in various prior art devices.

SUMMARY OF THE INVENTION

It is an object of the present invention to provide a new and useful restraint device which is inexpensive and lightweight in construction.

Another object of the present invention is to provide a restraint device that is reusable.

A further object of the present invention is to provide a restraint device of a cable-tie-type which is key operated and which is structured to resist picking.

Still a further object of the present invention is to provide a restraint device of improved structure to provide a more durable product.

To accomplish these objects the key operated restraining device of the present invention is adapted to create a securing loop of adjustable dimension in order to secure one or more objects, for example, to act as a releasable handcuff device for restraining persons taken into custody. Broadly, the key operated restraining device according to the present invention includes a locking head portion that has an interior, and an elongated strap has a proximal end connected to the locking head portion and extends terminate in a distal free end. The first surface of an elongated smooth or roughened strap is insertable through a locking head portion which is able to reversibly and securely engage the strap to form a securing loop of adjustable dimension.

A support block is disposed in the interior of the head portion and terminates in spaced relation with respect to an interior wall surface thereof. Similarly, a pawl member is disposed in the interior of the head portion and terminates in spaced relation to the wall surface. Thus, the region between the pawl member and the interior wall surface and between the support block and the interior wall surface form a slideway that is sized for close-fitted mated engagement with the strap portion. The pawl member includes a locking structure disposed thereon so that, when the strap portion is inserted into the locking head portion, the locking structure on the pawl member engages the smooth strap on the first surface of the elongated strap portion to lockably retain the strap portion therein. Thus, as the strap portion is moved in a direction to reduce the dimension of the securing loop, the spike engages the strap by penetrating the surface of the strap a short distance which is restricted by the pawl member. The spike is either forcibly inserted into the pawl at time of manufacture, press fitted after manufacture or molded into the pawl during the manufacturing process. The pawl member is connected to the locking head by means of a resilient hinge structure that biases the pawl member into a locking position to lockably engage the strap portion while the hinge structure maybe moved into a released position wherein the locking structure is disengaged from the strap. The pawl member and the support block are, together, configured to form a keyway therebetween which is sized and adapted to receive a key therein, and the pawl member is constructed so that rotation of the key in a first rotational direction moves the pawl element from the locking position to the release position.

Preferably, the locking head portion is formed as a housing that includes an upper wall, a lower wall opposite the upper wall and a pair of opposed sidewalls which interconnect the upper and lower walls thereby to define the interior. The support block and the pawl member are then connected to the upper wall such that a region between the interior surface of the lower wall and the support block and the pawl member defines the slideway. The strap then extends outwardly from the upper wall. The keyway is then preferably oriented along a keyway axis that is transverse to the slideway and the keyway may include an option post element that is located centrally in the keyway and that extends along the keyway axis. A key hole may be provided in one of the sidewalls with this key hole being aligned with the keyway so that a key may be inserted through a sidewall to matably engage the post structure, if there is one, while in the keyway after which the key may be rotated in the first rotational direction to disengage the pawl member, as desired. With this structure, the support block forms a first end wall for the locking head. An optional second endwall may be provided opposite the support block so that the interior of the locking head is substantially enclosed.

It is preferred that the strap member have a second surface which is formed as an uninterrupted planar surface. Similarly, the interior wall surface, such as the interior surface of the lower wall, may be formed in a smooth, uninterrupted plane so that the second surface of the strap portion may slidably engage the interior wall surface in a smooth, uninterrupted manner. To facilitate insertion of distal free end of the strap portion into the slideway, the region between the interior wall surface and the support block may be formed to be outwardly divergent thereby to form an enlarged entryway for the slideway.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

The present invention broadly relates to connecting devices of a type wherein a strap is placed around an object or objects to be secured with a free end of the strap being inserted into a locking head such that, when the loop is tightened, the strap retains the objects. The device according to the present invention is specifically adapted for use as a restraining device such as a reusable handcuff, although the present invention should not be limited to just such applications. Moreover, the present invention is specifically directed to a key operated restraining device which is adapted to create a securing loop of adjustable dimension yet which may be key operated to release the loop for release of such objects.

Figure 1:
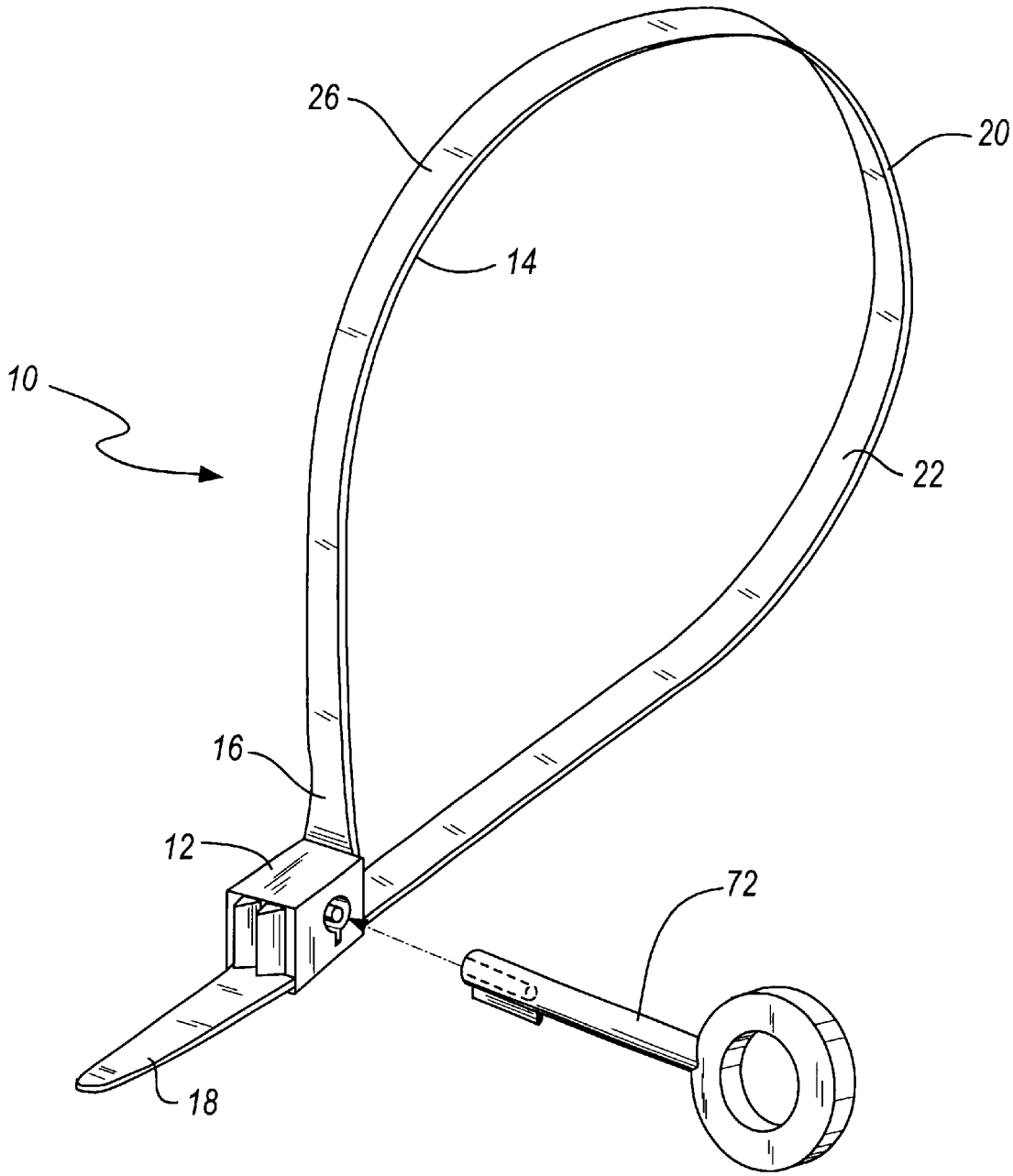
FIG. 1 is a perspective view of a key operated restraining device according to the first exemplary embodiment of the present invention.
Figure 5A:
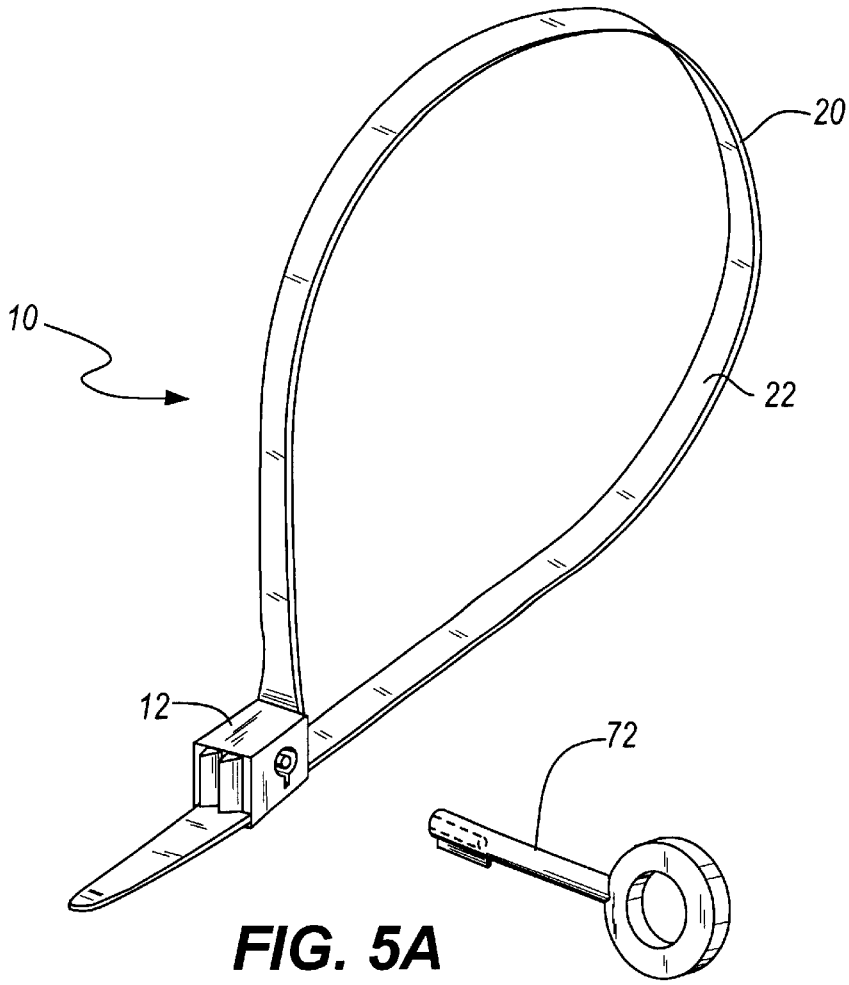
FIG. 5A depicts a perspective view of a key operated restraining device according to the first exemplary embodiment of the present invention showing the smooth/roughened strap rather than a toothed strap.
Figure 5B:
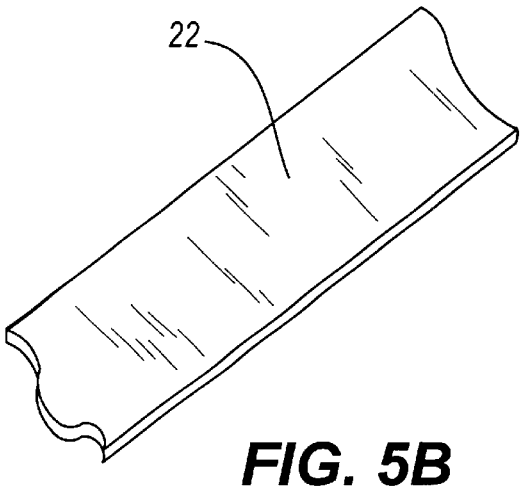
FIG. 5B shows a portion of a smooth strap embodiment of the present invention.
Figure 5C:
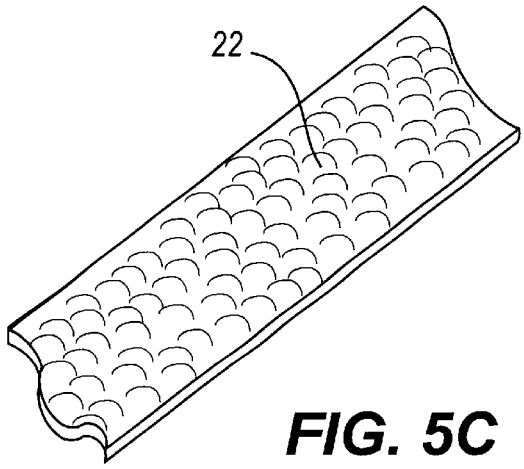
FIG. 5C shows a roughened or random non-toothed surface of the strap of the present invention.
Figure 7:
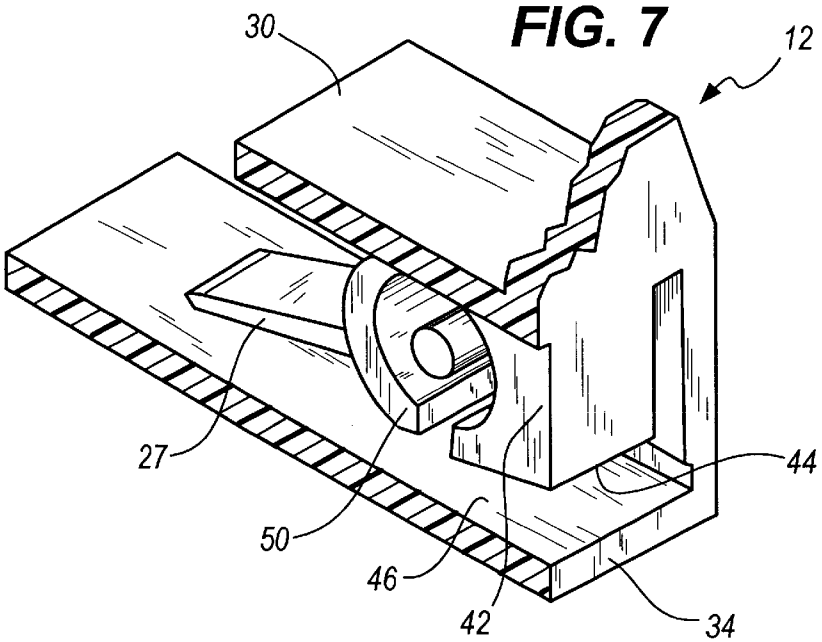
FIG. 7 is a perspective view of the locking head portion of the key operated restraining device showing the spike member connected to the locking head mechanism.

According to the first exemplary embodiment of the present invention then, as is shown in FIG. 1, restraining device 10 includes a locking head portion 12 and an elongated strap portion 14 which has a proximal end 16 connected to head portion 12 and a distal free end 18. A length of strap portion 14 adjacent distal free end 18 may be inserted through locking head portion 12 to form a closed securing loop of adjustable size. Strap portion 14 has a first surface 22 that is smooth and/or roughened, but, in contrast to the devices of Smith, U.S. Pat. Nos. 5,794,461 and 5,377,510, do not employ any teeth or toothed structures on the strap or in the locking head 12. It should be appreciated that references herein to a "smooth" surface also includes any non-toothed surface, and in particular includes a grainy, random or sandpaper-like surface (see FIG. 5C). A second surface 26 is located opposite the first surface. Both surfaces 22, 26 are preferably formed as smooth, uninterrupted planar surfaces to facilitate slidable engagement with the locking head portion 12, as described below.

Locking head portion 12 is best shown in FIGS. 2–5 where it may be seen that locking head portion 12 is preferably in the form of a housing 30 formed by an upper wall, a lower wall and a pair of sidewalls that thus surround an interior. Housing 30 is generally rectangular in construction with proximal end 16 portion of strap 14 extending as an integral piece from upper wall.

Figure 2:
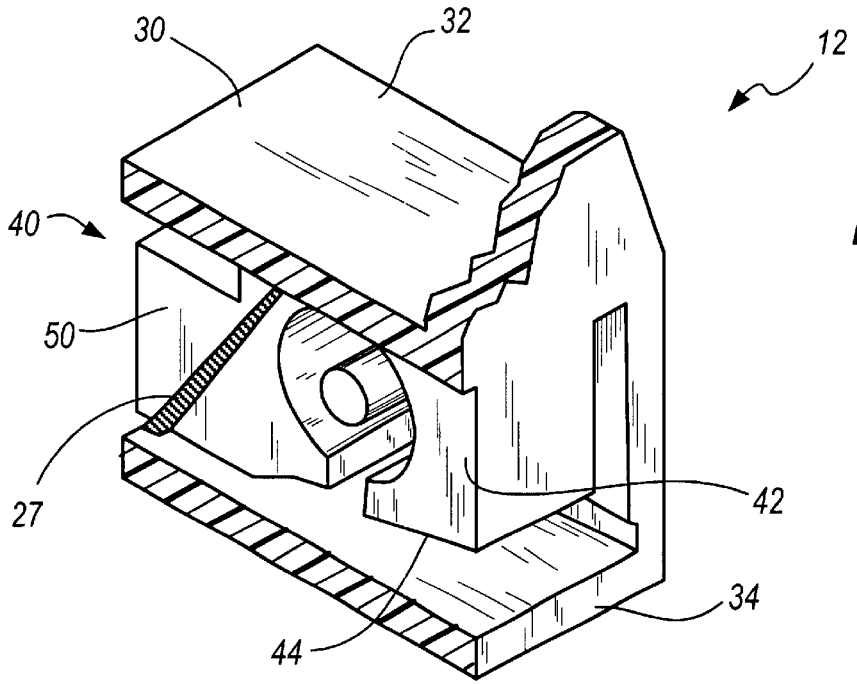
FIG. 2 is a perspective view of the locking head portion of the key operated restraining device shown in FIGS. 1.
Figure 3:
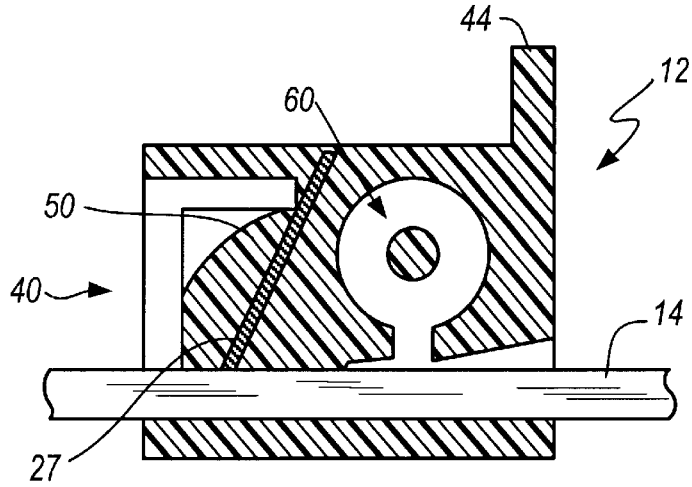
FIG. 3 is a cross sectional view and with a strap portion therein showing the pawl member in a locking position.
Figure 4:
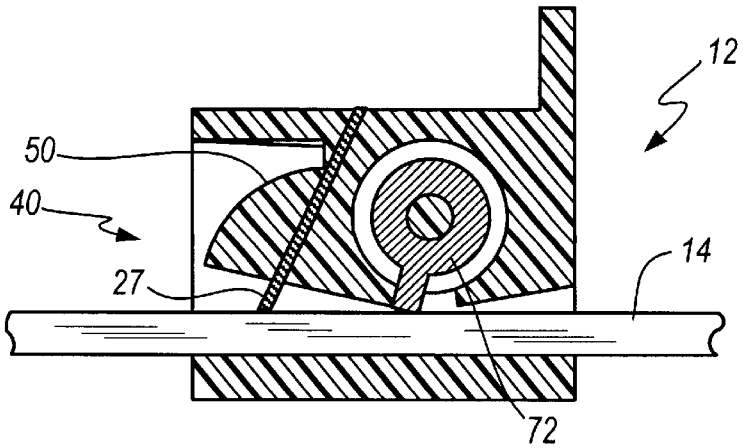
FIG. 4 is a side view in cross section, similar to FIG. 3 but showing the pawl member in a released position and with a key element inserted therein.

It may be seen that locking mechanism 40 is formed by a support block 42 that extends downwardly from upper wall and terminates in a lower surface 44 that is oriented in spaced relation to an interior wall surface of housing 30 as defined by an interior wall surface of lower wall. Similarly, locking mechanism 40 includes a pawl member 50 which extends downwardly from upper wall to terminate in a lower movable surface that has a locking structure defined by a protruding spike 27. This surface is likewise in spaced relation to wall surface and, respectively, lower surface 44 of support block 44 and the spike 27 of pawl member 50 form a slideway that is located alongside interior wall surface 46. To this end, interior wall surface 46 is formed as a smooth, uninterrupted planar surface. Lower surface 44 of support block 42 is formed obliquely to wall surface 46 so that this interior wall surface 46 and lower surface 44 are outwardly divergent from one another thereby to form an enlarged tapered entryway for slideway, as is best shown in FIG. 2.

Figure 9:
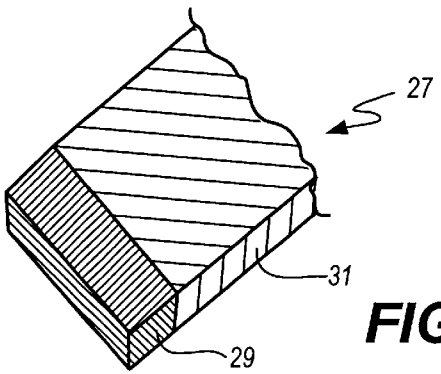
FIG. 9 is a partially broken away perspective view of a spike having a lower portion of steel and an upper portion of an elastomeric material.
Figure 6:
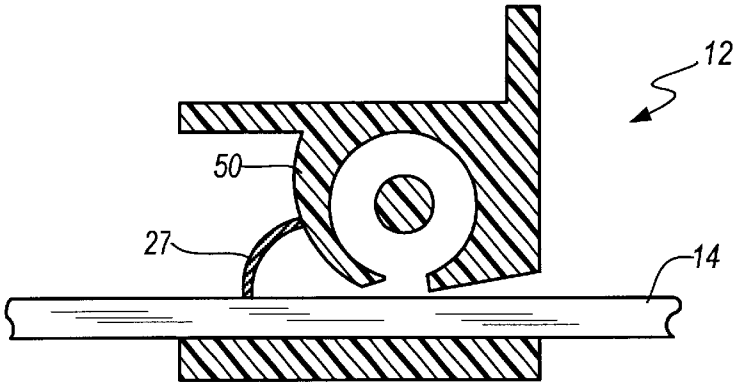
FIG. 6 shows a cross-sectional view showing how the strap is contacted with a spike member.
Figure 8:
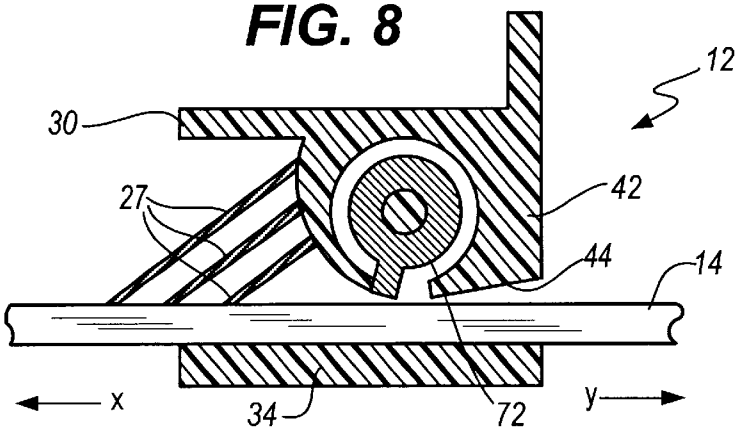
FIG. 8 is a side view in cross-section of another embodiment of the present invention having three spikes attached to the locking head mechanism.

A further description of the present invention is provided by incorporating by reference U.S. Pat. Nos. 5,794,461 and 5,377,510, with the important distinction being that the strap 14 used and the corresponding locking head structure 12 therein described are different, as set forth herein and in the present figures. According to the present invention, a particular advantage over prior art locking head 12 and tooth strap 14 devices is that the present invention does not rely upon a toothed strap that engages with a corresponding toothed locking member, thus rendering the present device truly infinitely adjustable given that there are no toothed structures that must be mated with corresponding tooth structures in a locking head 12. Instead, in a preferred embodiment of the present invention, at least one spike 27 is provided in the locking head structure 12, which takes the place of the ratchet teeth as described in the '461 and '510 patents. In a separate embodiment, more than one spike 27 is utilized to engage the smooth and/or roughened surface of a strap 14. Indeed, in various embodiments, the strap 14 material itself is such that, at least on the surface that engages the at least one spike 27, the plastic material is capable of being gouged such that the strap 14, when engaged by at least one spike 27, cannot move in at least one direction. Thus, as illustrated in FIG. 9, one or more spikes 27 dig into the plastic material of the strap 14 in a manner that affords a secure engagement at a particular desired point of loop stricture.

It will be appreciated that spike members 27 can be made of various materials, but preferably at least a portion of the spike 27 material, if not the entire spike 27 itself, comprises a metal feature 29 such that the spike 27 can easily and reversibly engage the plastic strap 14 in a manner that sinks the spike 27 into the plastic material for secure engagement purposes. Thus, in one embodiment, the tip 29 of a plastic spike 31 is provided with a metal engaging tip 29. In still other embodiments, the entire spike 27 is made of metal, preferably steel. Moreover, the actual tip of the spike 27 is configured so as to allow secure engagement with the smooth and/or roughened surface of the strap 14. Thus, the spike 27 tip can be a sharpened edge or a serrated edge, thus facilitating engagement with the plastic strap 14.

It will further be appreciated that the spike 27 itself is moved into and out of engagement with the plastic strap 14 upon operation of a rotatable key 72 in the locking head member 12. This is performed in a manner similar to that described in the '461 and '510 patents incorporated herein by this reference, except that a spike 27 replaces the ratcheted teeth that engage with a toothed strap in those patented embodiments.

A significant advantage of the present invention over the prior art devices is that the strap 14 can be more easily manufactured given the absence of any fine tooth structure that is necessary for prior art devices to operate. Moreover, the manufacture of the locking head structure 12 is greatly simplified by use of one or more spike 27 members, thus avoiding the use of a toothed ratchet-like member of the prior art which was designed solely to engage corresponding teeth in a toothed strap. The cost of the present invention 10 is believed to be lower than the toothed structure of the prior art devices and the inclusion of metal spikes 27 on various embodiments of the present invention, is also believed to establish a better and more secure engagement with a strap 14. For the same reason, the durability of the present device 10 is superior to prior art devices in that the preferred steel spike 27 tip can more reliably and securely contact the plastic strap 14.

It should be further appreciated that while, in a preferred embodiment, the spike member 27 is presented as a rectangle with a relatively sharp engaging edge that interacts with the strap 14, the spike 27 itself can be of any geometric configuration including one or more sharp poles, triangular configurations or cylindrical members. In one embodiment the spike 27 is such that the engaging tip is a needle-like configuration. Moreover, spikes 27 can be bent or curved to add to their respective strength characteristics and to accommodate better angled contact with a strap 14 and/or better contact with the key 72, thus facilitating improved operability of the reversible engagement between spike 27 and strap 14.

The manner in which a spike member 27 is attached into the locking head 12 may vary. For example, the spike member 27 itself, either comprising a hardened plastic or metal material, may be of a thickness that allows some flexibility so that the key 72, when rotated, can flex the member 27 out of engagement with the strap 14. Alternatively, a more rigid spike member 27 can be connected in the locking head 12 at a pivot point, such pivot point being constructed, for example, of a flexible plastic such that when the key engages the spike member 27, the spike member rotates/bends about the pivot point, essentially reversibly deforming the plastic within which the spike member 27 is embedded, thus allowing the spike to reversibly engage the strap.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiment of the present invention without departing from the inventive concepts contained herein.

What is claimed is:

1. A key operated restraining device adapted to create a securing loop of adjustable dimension, comprising:

a locking head portion having an interior;

an elongated strap portion having a proximal end connected to said head portion and a distal free end, said strap portion including a smooth first surface thereof, said strap portion having sufficient length such that said free distal end is insertable through said locking head portion thereby to form a securing loop of adjustable dimension;

a support block disposed in the interior of said head portion and termination in spaced relation to an interior wall surface thereof; and a pawl member disposed in the interior of said head portion and terminating in spaced relation to said wall surface, said pawl member including a locking structure disposed thereon, said pawl member, said support block and said wall forming a slideway sized for close fitting mated engagement with said strap portion, said strap portion being slideably movable in a first direction to reduce the dimension of said securing loop and in a second direction to expand the dimension of said securing loop, said pawl member connected to said locking head by a resilient hinge structure with a supporting spike member biasing said pawl member into a locking position, wherein said spike member is operative to lockably engage said strap and having a release position wherein said spike member is disengaged from said strap, said pawl member operative when in the locking position to permit movement of said strap in the first direction but to prevent movement of said strap in the second direction, said pawl member and said support block configured to form a keyway therebetween sized and adapted to receive said key therein, said keyway oriented along a keyway axis that is transverse to said slideway and including a post element that is located centrally in the keyway axis, said pawl member constructed such that rotation of said key in a first rotational direction moves said pawl element from the locking position to the release position; and wherein said spike member has a sharpened metal edge that engages the smooth surface of said strap such that said metal tip is partially embedded into said strap.

2. A key operated restraining device adapted to create a securing loop of adjustable dimension, comprising:

a locking head portion having an interior;

an elongated strap portion having a proximal end connected to said head portion and a distal free end, said strap portion including a smooth first surface thereof, said strap portion having sufficient length such that said free distal end is insertable through said locking head portion thereby to form a securing loop of adjustable dimension;

a support block disposed in the interior of said head portion and termination in spaced relation to an interior wall surface thereof; and a pawl member disposed in the interior of said head portion and terminating in spaced relation to said wall surface, said pawl member including a locking structure disposed thereon, said pawl member, said support block and said wall forming a slideway sized for close fitting mated engagement with said strap portion, said strap portion being slideably movable in a first direction to reduce the dimension of said securing loop and in a second direction to expand the dimension of said securing loop, said pawl member connected to said locking head by a resilient hinge structure with a supporting spike member biasing said pawl member into a locking position, wherein said spike member being operative to lockably engage said strap and a release position wherein said spike member is disengaged from said strap, said pawl member operative when in the locking position to permit movement of said strap in the first direction but to prevent movement of said strap in the second direction, said pawl member and said support block configured to form a keyway therebetween sized and adapted to receive said key therein, said keyway oriented along a keyway axis that is transverse to said slideway and including a post element that is located centrally in the keyway axis, said pawl member constructed such that rotation of said key in a first rotational direction moves said pawl element from the locking position to the release position;

said spike member constructed at least in part of metal, said spike member having a sharpened metal edge that engages the surface of said strap such that said metal tip is partially embedded into said strap when in an engaging position.

3. The key operated restraining device as set forth in claim 1, wherein there are more than one spike members retained in said locking head for engagement with said strap.

4. The key operated restraining device as set forth in claim 1, wherein said spike member is of a needle-like design and said tips of said needle spike member engages said smooth surface of said strap.

5. The key operated restraining device as set forth in claim 1, wherein said strap is lacking any toothed-like structures and said locking head is devoid of any corresponding tooth structure to engage with teeth on said strap.

6. A key operated restraining device according to claim 1 wherein the keyway is oriented along a keyway axis that is transverse to said slideway and including a post element that is located centrally in the keyway and that extends along the keyway axis.

7. A key operated restraining device according to claim 1 wherein said locking head includes an upper wall, a lower wall opposite said upper wall, and a pair of opposed sidewalls interconnecting said upper and lower walls thereby to define the interior of said locking head, said support block and said pawl member being connected to said upper wall such that said slideway is defined by a region between said lower wall and said support block and said pawl member, and wherein said strap member extends outwardly from said upper wall.

8. A key operated restraining device according to claim 7 wherein one of said sidewalls has a key opening formed therethrough which is aligned with said keyway thereby to permit insertion of said key therein, said key opening operative to support said key during rotation thereof in said keyway.

9. A key operated restraining device according to claim 7 wherein said support block forms a first endwall for said locking head.

10. A key operated restraining device according to claim 9 including a second endwall located oppositely of said support block.

11. A key operated restraining device according to claim 7 wherein said lower wall defines the interior wall surface, the interior wall surface being formed as a smooth, uninterrupted planar surface, said strap portion having a second surface opposite the first surface that is formed as a smooth uninterrupted planar surface adapted for sliding engagement with the interior wall surface.

12. A key operated restraining device according to claim 1 wherein a portion of the region located between said interior wall surface and said support block is outwardly divergent thereby to form an enlarged entryway for the slideway.

13. A key operated restraining device according to claim 1 wherein said locking structure includes a smooth strap such that, when said pawl member is in the locking position with said strap portion located within the slideway, a spike member on said pawl engages the smooth portion of the strap.

* * * * *